US008419459B2

(12) United States Patent
Nihei et al.

(10) Patent No.: US 8,419,459 B2
(45) Date of Patent: Apr. 16, 2013

(54) CONNECTOR PORT

(75) Inventors: Koichiro Nihei, Chiyoda-ku (JP); Katsunao Aizawa, Chiyoda-ku (JP); Haruhiko Kondo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 163 days.

(21) Appl. No.: 12/934,171

(22) PCT Filed: Mar. 26, 2009

(86) PCT No.: PCT/JP2009/056173

§ 371 (c)(1),
(2), (4) Date: Sep. 23, 2010

(87) PCT Pub. No.: WO2009/119762

PCT Pub. Date: Oct. 1, 2009

(65) Prior Publication Data

US 2012/0003867 A1 Jan. 5, 2012

(30) Foreign Application Priority Data

Mar. 27, 2008 (JP) ..... 2008-084612

(51) Int. Cl.
*H01R 13/629* (2006.01)

(52) U.S. Cl.
USPC ..... 439/341

(58) Field of Classification Search ..... 439/341, 439/157, 159, 160, 372, 152, 144, 373
See application file for complete search history.

(56) References Cited

U.S. PATENT DOCUMENTS

| | | | | |
|---|---|---|---|---|
| 6,267,608 | B1 | 7/2001 | Yagi | |
| 6,267,614 | B1 * | 7/2001 | Good et al. | 439/327 |
| 7,201,407 | B2 * | 4/2007 | Schlack | 292/139 |
| 7,679,933 | B2 * | 3/2010 | Makabe | 361/801 |
| 2007/0287320 | A1 * | 12/2007 | Shiota et al. | 439/352 |

FOREIGN PATENT DOCUMENTS

| | | | |
|---|---|---|---|
| JP | 51-145592 | A | 11/1976 |
| JP | 54-59117 | U | 4/1979 |
| JP | 57-29192 | U | 2/1982 |
| JP | 2-12174 | U | 1/1990 |
| JP | 4-124774 | U | 11/1992 |

(Continued)

OTHER PUBLICATIONS

Japanese Office Action issued in corresponding Japanese Patent Application No. 2010-505791 dated Jan. 17, 2012.

*Primary Examiner* — Tulsidas C Patel
*Assistant Examiner* — Phuongchi Nguyen
(74) *Attorney, Agent, or Firm* — Sughrue Mion, PLLC

(57) ABSTRACT

A connector port provided on the outer surface of a housing of an electronic device includes: a connector holding section that is formed in the housing and has a connector opening; and an opening/closing cover including an attaching section that is screwed to the connector holding section, a flat cover section that is pivotably supported by the attaching section at the proximal end thereof and opens and closes the connector opening, and an elastically deforming section that is provided at the distal end of the cover section and elastically deforms to engage in the connector holding section. The connector holding section is formed as a recess on the outer surface of the housing, the opening/closing cover is housed in the recess, and the outer surface of the housing and the outer surface of the cover section are substantially flush with each other.

4 Claims, 12 Drawing Sheets

FOREIGN PATENT DOCUMENTS

| | | | |
|---|---|---|---|
| JP | 06-088069 | U | 12/1994 |
| JP | 10-091286 | A | 10/1998 |
| JP | 2000-100517 | A | 4/2000 |
| JP | 2003-036936 | A | 2/2003 |
| JP | 2003-142841 | A | 5/2003 |
| JP | 2007-242241 | A | 9/2007 |

* cited by examiner

CONNECTOR PORT

TECHNICAL FIELD

The present invention relates to connector ports having a fluid-tight structure that function as connection ports for connectors such as USB connectors provided in electronic devices such as a control device and a touch panel display.

BACKGROUND ART

In the past, there is a battery cover structure that protects a battery housing provided in the inside of an electronic device while allowing the battery housing to freely open and close and keeps the battery housing in a water-tight state with respect to the outside. The battery cover includes a sealing section that is pivotably supported with respect to the electronic device and seals the battery housing in a closed position of the battery cover and a battery cover member that is slidably attached to the sealing section on the outer side of the sealing section, seals the battery housing in the closed position, and engages in a part of the electronic device according to the slide (See, for example, Patent Document 1).

Patent Document 1: Japanese Patent Application Laid-Open No. 2003-142841

DISCLOSURE OF INVENTION

Problem to be Solved by the Invention

However, according to the technology in the past, the battery cover includes a plurality of members. The number of members is large and a sliding mechanism is complicated. The battery cover can be attached to only a corner of the electronic device and cannot be attached to a plane section.

The present invention has been devised in view of the above and it is an object of the present invention to obtain a connector port that is simple in structure and high in liquid tightness and can be set on a plane section of a housing of an electronic device.

Means for Solving Problem

Effect Of The Invention

The connector port according to the present invention realizes an effect that the connector port is simple in structure, high in liquid tightness, and convenient for use.

EXPLANATIONS OF LETTERS OR NUMERALS

Figure 1:
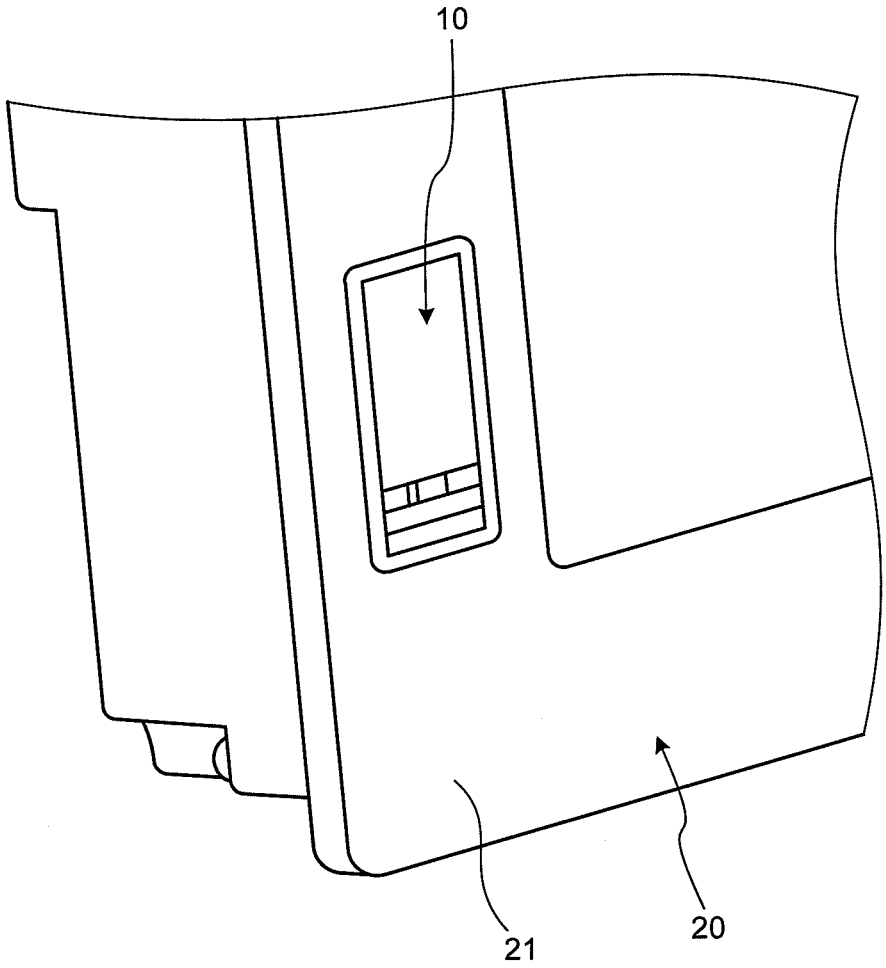
FIG. 1 is a perspective view of a part of a display of a control board in which a connector port according to the present invention is provided.

10 connector port
20 display
21 housing
22, 22*a* connector openings
23 connector holding section
23*a* corner
23*b* drain grooves
23*c* hole section
23*d* sidewall
23*e* recess
23*f* sidewall
23*k* engaging sections (holes)
23*m* hollow
30 opening/closing cover
31 flat head screw
31 attaching section
32*a* supporting section
32*b* attaching plate
32*f* taper screw washer
32*g* screw through-hole
32*h* slit
32*j* locking sections (projections)
33 cover section
33*a* proximal end
33*b* distal end
33*c* rear end
33*f* side flanges
34 elastically deforming section (U-shaped plate section)
34*a* proximal plate section
34*b* distal plate section
34*c* knob section
34*d* projection
35 annular packing (packing)
37, 37B, 37C connector locking plates
37*x* bifurcated section
37*y* locking hole
37*z* cutout section
40 connector
41 cord
41*a* base section

BEST MODE(S) FOR CARRYING OUT THE INVENTION

Embodiments of a connector port according to the present invention are explained in detail below with reference to the drawings. The present invention is not limited by the embodiments.

First Embodiment.

Figure 2:
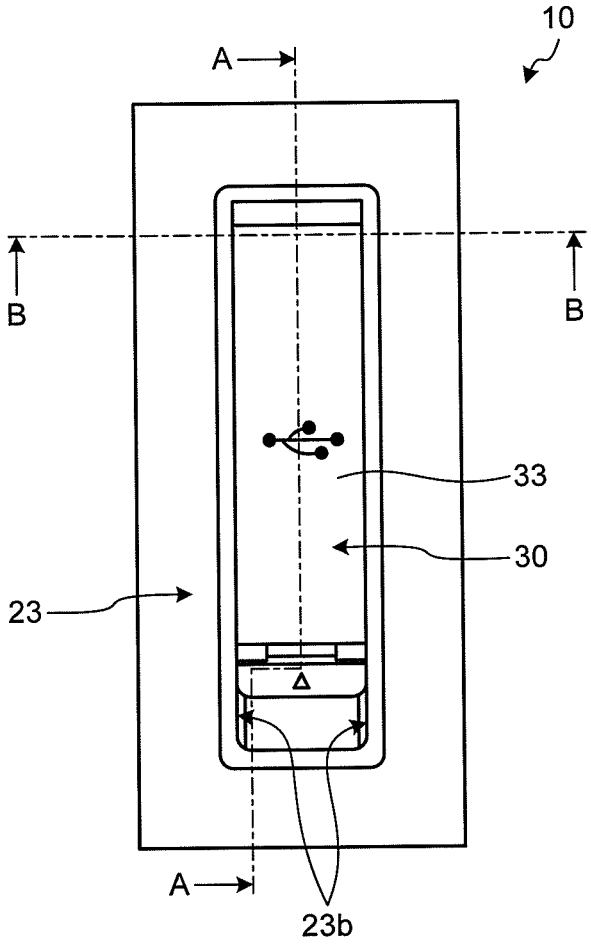
FIG. 2 is a front view of the connector port of a first embodiment according to the present invention.
Figure 3:
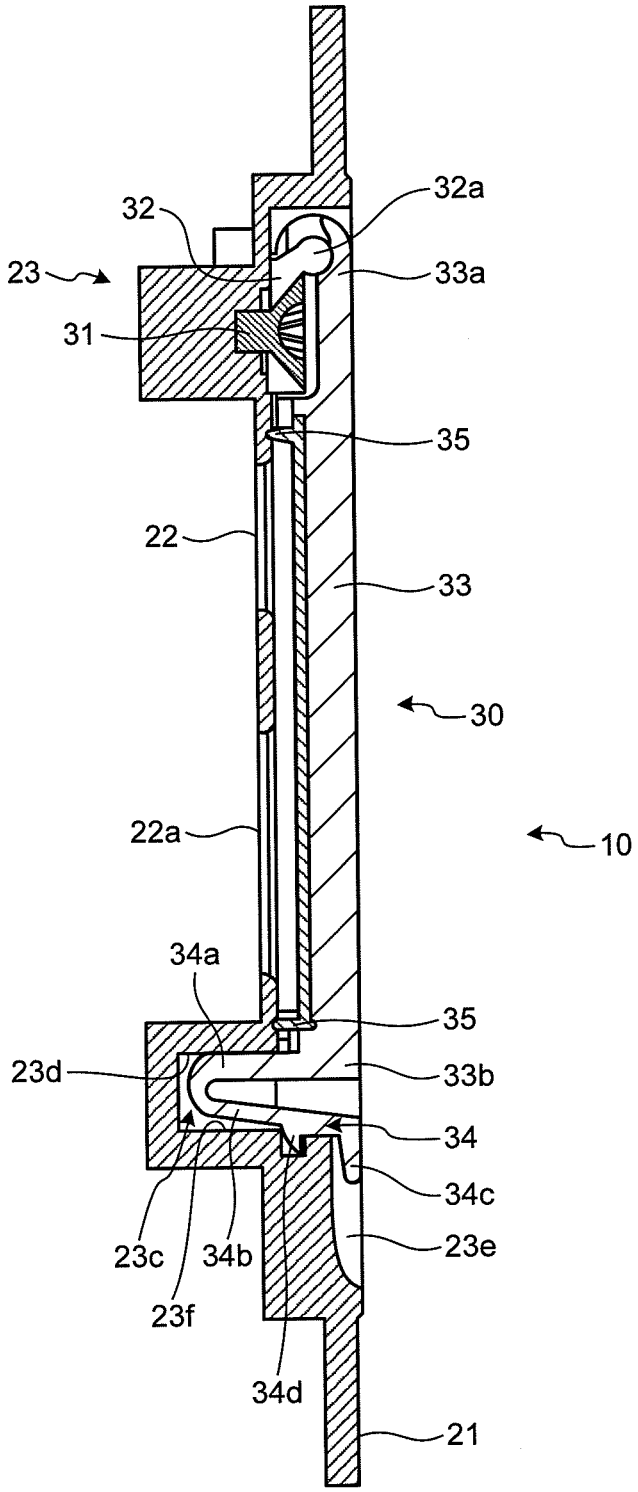
FIG. 3 is a longitudinal sectional view taken along line A-A shown in FIG. 2.
Figure 4:
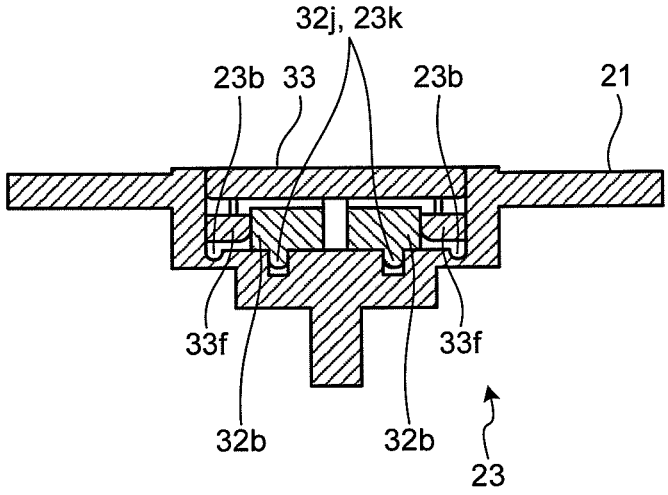
FIG. 4 is a cross sectional view taken along line B-B shown in FIG. 2.
Figure 5:
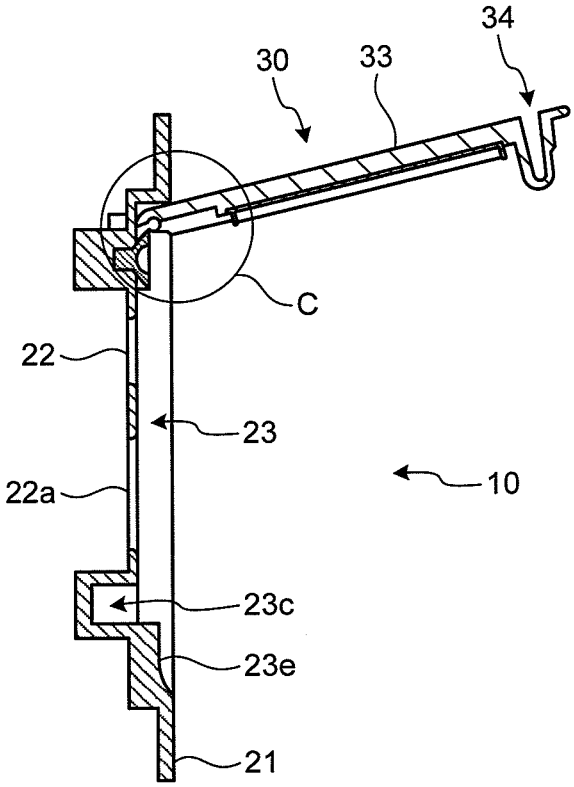
FIG. 5 is a longitudinal sectional view of the connector port in a state in which an opening/closing cover is fully opened.
Figure 6:
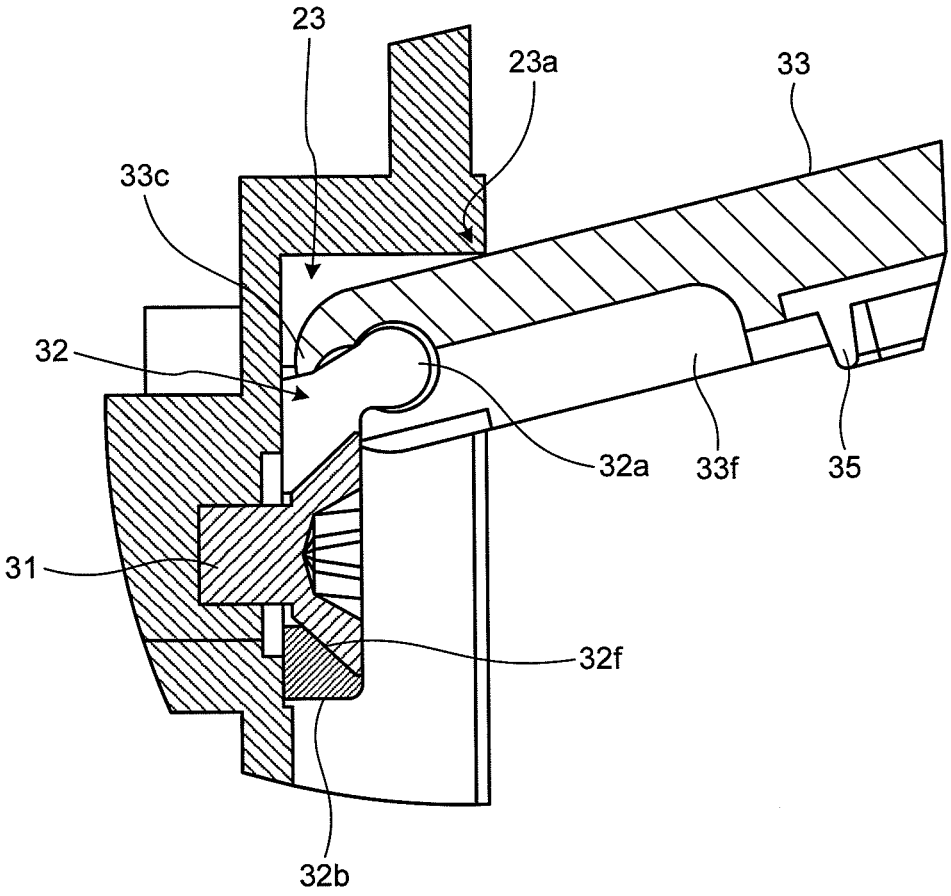
FIG. 6 is an enlarged view of a C section shown in FIG. 5.
Figure 7:
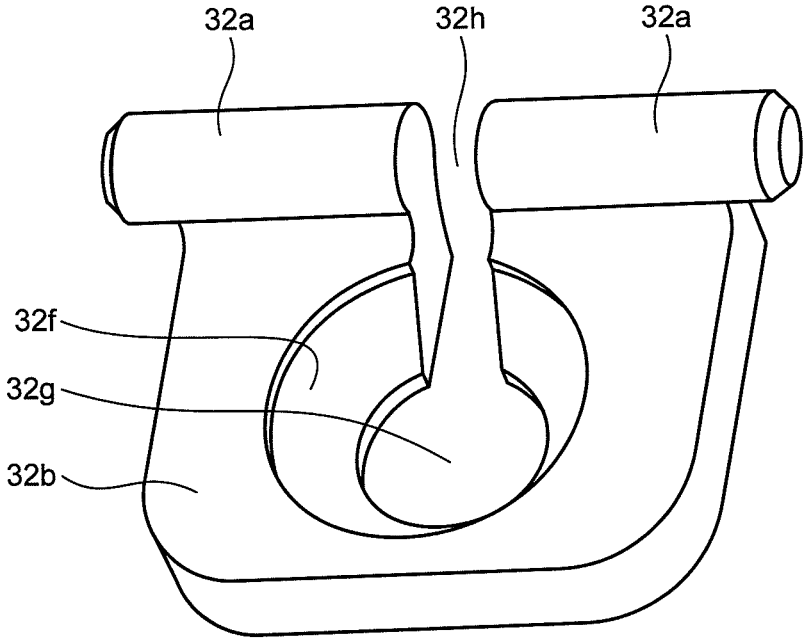
FIG. 7 is a front perspective view of an attaching plate.
Figure 8:
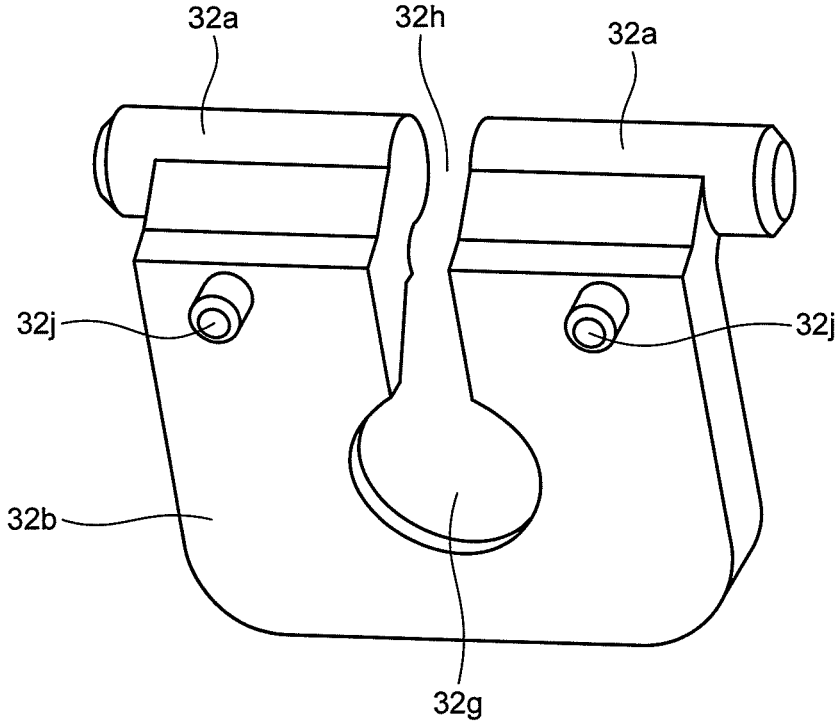
FIG. 8 is a rear perspective view of the attaching plate.
Figure 9:
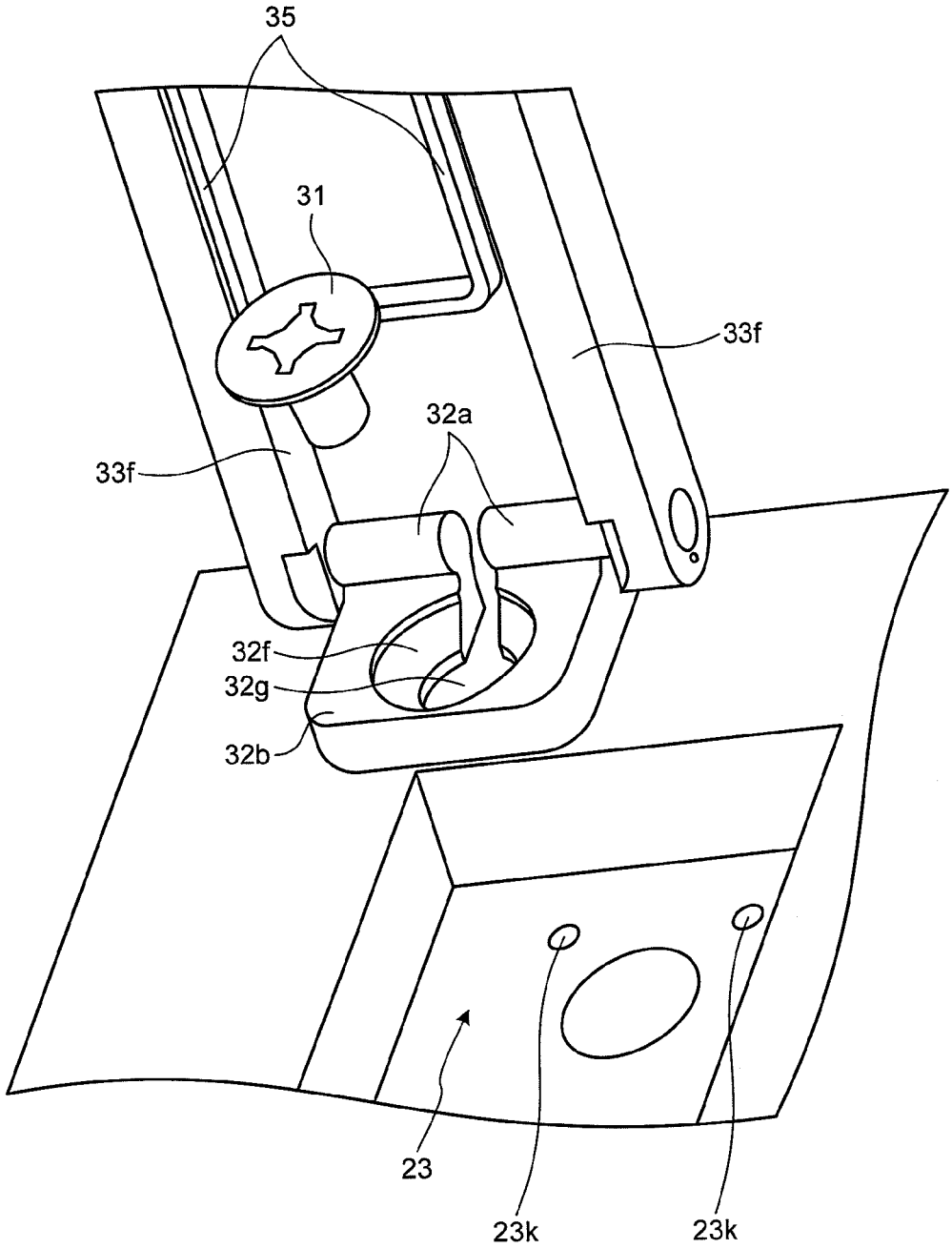
FIG. 9 is a perspective view of a state in which the opening/closing cover is screwed to a connector holding section.
Figure 10:
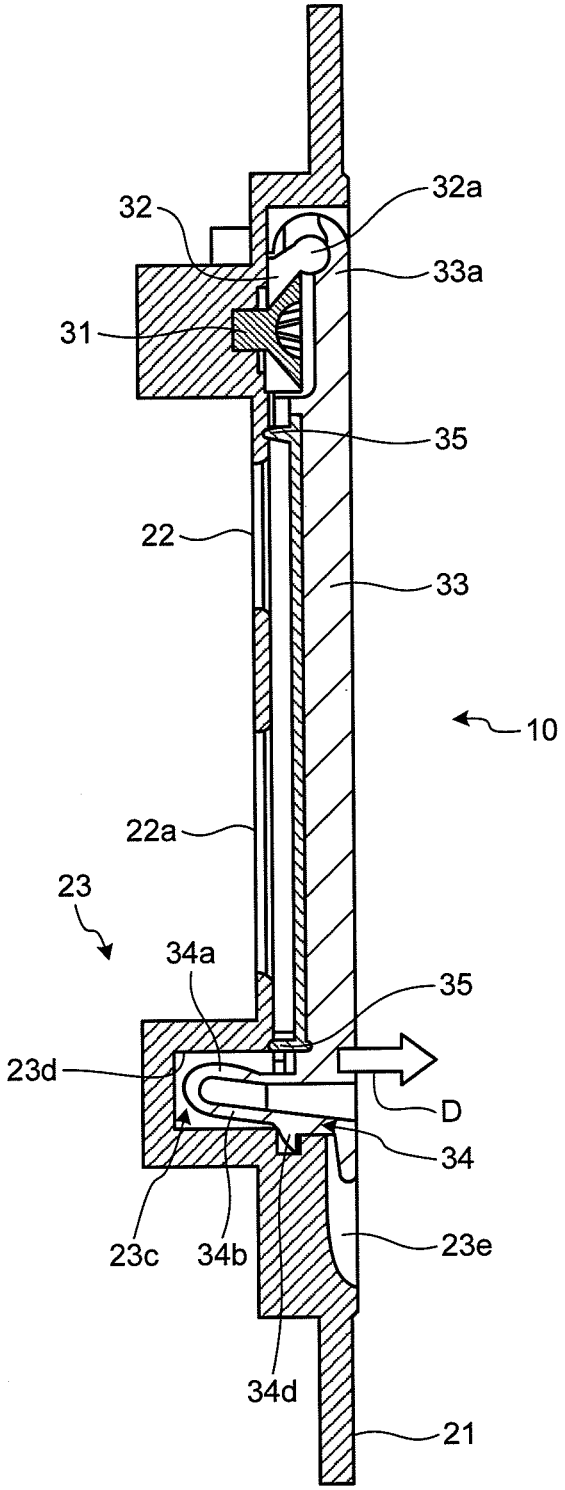
FIG. 10 is a longitudinal sectional view of a comparative example with respect to a hole section and a U-shaped plate section in the first embodiment.

FIG. 1 is a perspective view of a part of a display of a control board in which a connector port according to the present invention is provided, FIG. 2 is a front view of a first embodiment of the connector port according to the present invention, FIG. 3 is a longitudinal sectional view taken along line A-A shown in FIG. 2, FIG. 4 is a cross sectional view taken along line B-B shown in FIG. 2, FIG. 5 is a longitudinal sectional view of the connector port in a state in which an opening/closing cover is fully opened, FIG. 6 is an enlarged view of a C section shown in FIG. 5, FIG. 7 is a front perspective view of an attaching plate 32, FIG. 8 is a rear perspective view of the attaching plate 32, FIG. 9 is a perspective view of a state in which an opening/closing cover 30 is screwed to a connector holding section 23, and FIG. 10 is a longitudinal sectional view of a comparative example with respect to a hole section 23*c* and a U-shaped plate section 34 in the first embodiment.

As shown in FIG. 1, a connector port 10 according to the first embodiment is provided on the outer surface of a housing 21 of a touch panel display 20 of a control board as an electronic device. The connector port 10 according to the present invention can be used not only for the display 20 but also for various electronic devices required to have liquid tightness.

As shown in FIGS. 2 and 3, the connector port 10 includes a connector holding section 23 that is formed in the housing 21 and has connector openings 22 and 22*a* and an opening/closing cover 30 that is attached to the connector holding section 23 and opens and closes the openings 22 and 22*a*.

The opening/closing cover 30 includes an attaching section 32 that is screwed to the connector holding section 23 by a flat head screw 31, a rectangular flat cover section 33 that is pivotably supported at a proximal end 33*a* thereof by the attaching section 32 and opens and closes the connector openings 22 and 22*a*, and an elastically deforming section 34 that is provided at a distal end 33*b* of the cover section 33 and elastically deforms and engages in the connector holding section 23 to cause the cover section 33 to seal the connector openings 22 and 22*a*.

As shown in FIGS. 3 and 9, an annular packing 35 made of elastomer is fixedly attached to the rear surface of the cover section 33. The annular packing 35 is sandwiched between the cover section 33 and the connector holding section 23 and surrounds the connector openings 22 and 22*a* to liquid-tightly seal the connector openings 22 and 22*a*.

The annular packing 35 has a shape obtained by forming an annular packing on the outer periphery of a rectangular elastomer flat plate. The cover section 33 made of resin and the annular packing 35 are integrally molded by different material simultaneous molding. The annular packing 35 can be held by the connector holding section 23. The connector openings 22 and 22*a* can be liquid-tightly sealed by the packing 35.

As shown in FIGS. 3 and 4, the connector holding section 23 is formed as a rectangular recess on the outer surface of the housing 21. In the connector holding section 23, the opening/closing cover 30 is housed in the recess and the outer surface of the housing 21 and the outer surface of the cover section 33 are substantially flush with each other. Therefore, when a touch panel of the display 20 is operated, the cover section 33 is not an obstacle.

As shown in FIGS. 5 and 6, when the cover section 33 is fully opened by an angle equal to or larger than 90° and the outer surface of the cover section 33 comes into contact with a corner 23*a* of the connector holding section 23 (the recess), a rear end 33*c* of the cover section 33 cones into contact with the rear end of the attaching section 32. Therefore, even if unnatural force for further opening the cover section 33 is applied thereto, the force is not applied to a supporting section 32*a* explained later. Breakage of the supporting section 32*a* can be prevented.

As shown in FIG. 4, drain grooves 23*b* extending over the entire length of the recess are formed on both sides of the recess of the connector holding section 23. By providing the drain grooves 23*b*, machine oil or the like scattering from a machine tool or the like and intruding into the recess from the outer peripheral edge of the cover section 33 is discharged to the outside of the recess through the drain grooves 23*b*. Therefore, the oil or the like is not held up in the recess. When the cover section 33 is opened, the oil or the like does not intrude into the connector.

As shown in FIGS. 3 and 5, the elastically deforming section 34 is formed as a U-shaped plate section 34 including a proximal plate section 34*a* that bends at a substantially right angle and extends from a distal end 35 of the cover section 33 and a distal plate section 34*b* that bends and extends to make a U-turn from the proximal plate section 34*a* and engages in the connector holding section 23 to be compressed and bent to be deformed. The thickness of the proximal plate section 34*a* is formed larger than the thickness of the distal plate section 34*b*.

The hole section 23*c* into which the U-shaped plate section 34 is inserted is formed in the connector holding section 23. The hole section 23*c* is arranged such that the proximal plate section 34*a* of the U-shaped plate section 34 comes into contact with a sidewall 23*d* of the hole section 23*c* when the U-shaped plate section 34 is inserted into the hole section 23*c*.

A comparative example with respect to the hole section 23*c* and the U-shaped plate section 34 in the first embodiment shown in FIG. 3 is shown in FIG. 10. As shown in FIG. 10, the thickness of the proximal plate section 34*a* and the distal plate section 34*b* are set the same. The hole section 23*c* is arranged such that the proximal plate section 34*a* of the U-shaped plate section 34 does not come into contact with the sidewall 23*d* of the hole section 23*c* when the U-shaped plate section 34 is inserted into the hole section 23*c*. Then, the proximal plate section 34*a* is bent to be deformed to the proximal end 33*a* side. Force in an arrow D direction (a direction in which the cover section 33 opens) acts on the cover section 33 because of the bending deformation of the proximal plate section 34*a* and the packing 35 rises. The connector openings 22 and 22*a* cannot be sealed.

In the first embodiment, as explained above, the thickness of the proximal plate section 34*a* is formed larger than the thickness of the distal plate section 34*b*. The proximal plate section 34*a* of the U-shaped plate section 34 comes into contact with the sidewall 23*d* of the hole section 23*c* when the U-shaped plate section 34 is inserted into the hole section 23*c*. Therefore, the packing 35 does not rise and the connector openings 22 and 22*a* can be sealed.

As shown in FIG. 3, a knob section 34*c* that bends at a substantially right angle and extends from the distal plate section 34*b* is provided at the distal end of the distal plate section 34*b*. A shallow recess 23*e* is formed in the connector holding section 23 near the knob section 34*c*. A projection 34*d* that engages in a hollow formed in a sidewall 23*f* of the hole section 23*c* is provided in an intermediate section of the distal plate section 34*b*.

When a user inserts a fingertip into the recess 23*e*, pinches the knob section 34*c*, and presses the distal plate section 34*b* to compress and bend to deform the distal plate section 34*b*, the projection 34*d* slips out of the hollow. If the user pulls the knob section 34*c* to the outer side from that state and draws out the U-shaped plate section 34 from the hole section 23*c*, the user can open the cover section 33 and insert a not-shown male connector into a not-shown female connector.

As shown in FIGS. 3 to 9, the attaching section 32 of the opening/closing cover 30 includes an attaching plate 32*b* in which a taper screw washer 32*f* and a screw through-hole 32*g* for a flat head screw are formed and the supporting section 32*a* provided at an edge of the attaching plate 32*b*. A slit 32*h* extending from the center of the supporting section 32*a* to the screw through-hole 32*g* is formed.

When the taper screw washer 32*f* is tightened to the flat head screw 31, the attaching plate 32*b* is widened by a wedge action of the flat head screw 31 and brought into press contact with side flanges 33*f* of the cover section 33. Frictional force is generated between the attaching plate 32*b* and the side flanges 33*f*. The cover section 33 is held in a position to which the cover section 33 is opened by the frictional force. Therefore, when the user inserts the male connector with one hand, the user does not need to hold the cover section 33 in an open state with the other hand.

As shown in FIGS. 4, 8, and 9, locking sections (projections having a diameter smaller than the diameter of engaging sections (holes) 23*k* formed in the connector holding section 23) 32*j* are provided on the attaching plate 32*b* on both sides of the slit 32*h*. The locking sections 32*j* engage in the holes 23*k*, position the attaching plate 32*b* in the connector holding section 23, and regulate a widening amount of the attaching plate 32*b*.

As explained above, when the taper screw washer 32*f* is tightened to the flat head screw 31, the attaching plate 32*b* is widened by the wedge action of the flat head screw 31 and brought into press contact with the side flanges 33*f* of the cover section 33. At this point, the projections 32*j* come into contact with the sidewalls of the holes 23*k* and regulate the widening amount of the attaching plate 32*b*.

Second Embodiment.

Figure 11:
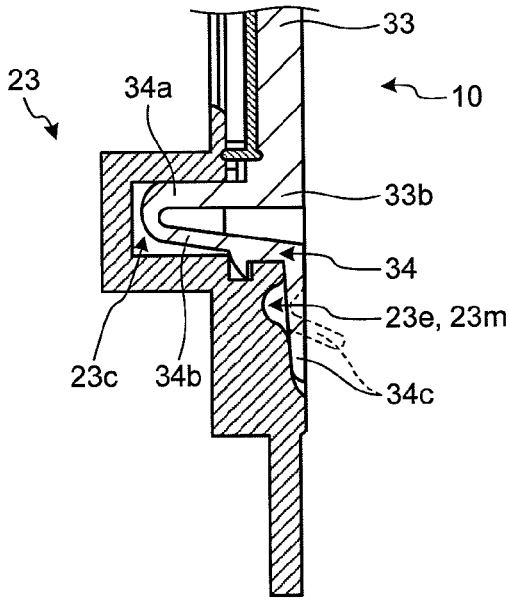
FIG. 11 is a longitudinal sectional view of a knob section in a second embodiment of the connector port according to the present invention.

FIG. 11 is a longitudinal sectional view of a knob section in a second embodiment of the connector port according to the present invention. The connector port 10 according to the second embodiment is different from the connector port 10 according to the first embodiment only in the knob section 34*c*. Therefore, the knob section 34*c* and the sections related thereto are explained and explanation of the other sections is omitted.

As shown in FIG. 11, the knob section 34*c* in the second embodiment that bends at a substantially right angle and extends from the distal plate section 34*b* is provided at the distal end of the distal plate section 34*b*. The knob section 34*c* in the second embodiment is made of elastomer and formed in length substantially the same as the length of the shallow recess 23*e* of the connector holding section 23. A hollow 23*m* having a curved bottom is formed in the recess 23*e* in a region, which is close to the distal plate section 34*b*, covered by the knob section 34*c*.

When a user presses the knob section 34*c* on the hollow 23*m* with the index finger, a pressed section is dented and the distal end rises. When the user pinches the distal end of the risen knob section with the index finger and the thumb and presses the distal plate section 34*b* to compress and bend to deform the distal plate section 34*b*, the projection 34*d* slips out of the hollow. If the user pulls the knob section 34*c* to the outer side from that state and draws out the U-shaped plate section 34 from the hole section 23*c*, the user can open the cover section 33 and insert a not-shown male connector into a not-shown female connector.

With the knob section 34*c* in the second embodiment, it is easy to pinch the knob section 34*c* and the recess 23*e* is closed by the knob section 34*c*. Therefore, foreign matters and oil are not held up in the recess 23*e*. The connector port 10 is clean and excellent in appearance.

Third Embodiment.

Figure 12:
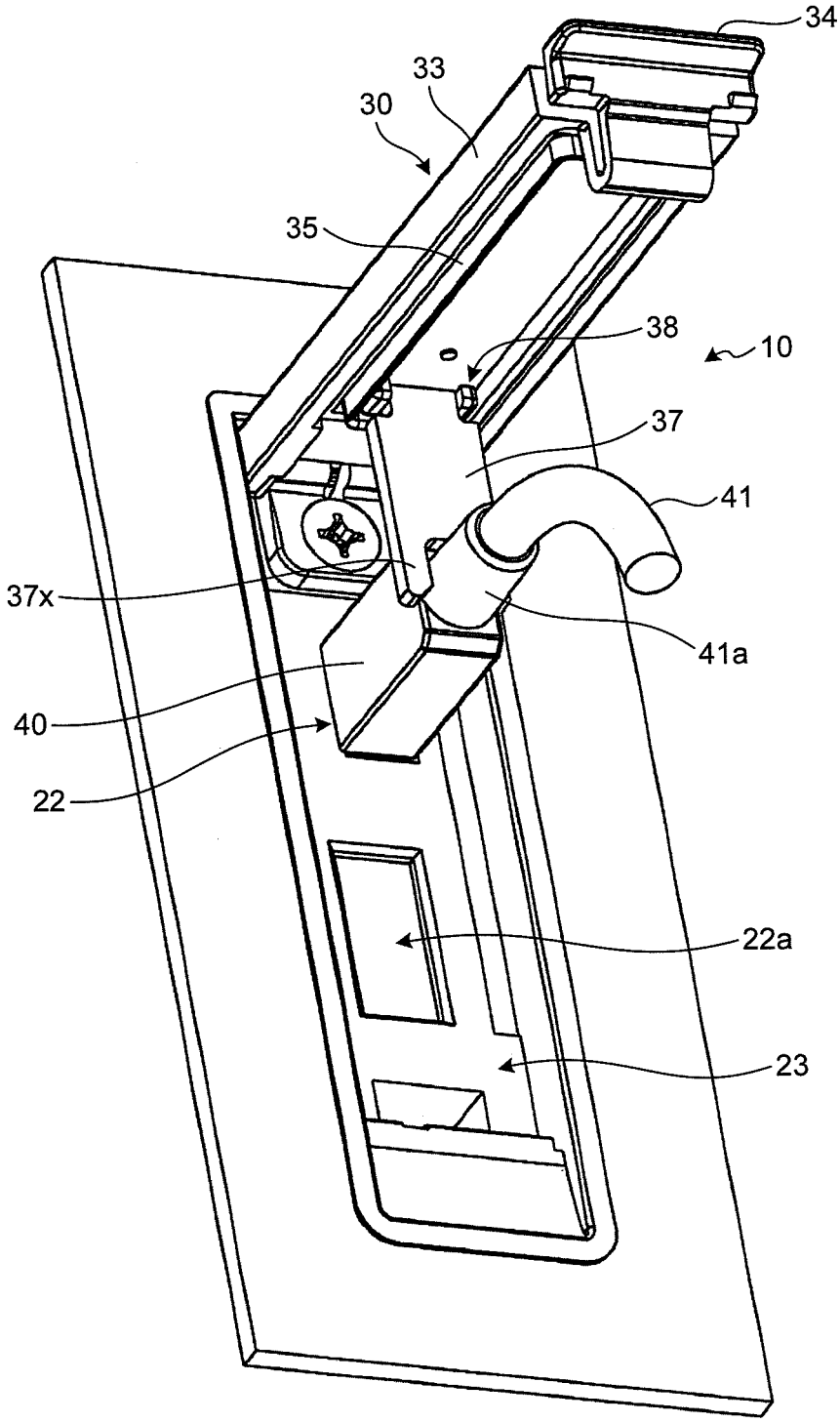
FIG. 12 is a perspective view of a connector locking plate in a third embodiment of the connector port according to the present invention.

FIG. 12 is a perspective view of a connector locking plate in a third embodiment of the connector port according to the present invention. The connector port 10 according to the third embodiment is different from the connector port 10 according to the first embodiment only in that a connector locking plate 37 is provided. Therefore, the connector locking plate 37 and sections related thereto are explained and explanation of the other sections is omitted.

As shown in FIG. 12, the connector locking plate 37 having rigidity is provided on the rear side of the cover section 33 of the opening/closing cover 30. The connector locking plate 37 prevents a connector 40 inserted into the connector opening 22 from slipping off. The proximal end of the connector locking plate 37 is attached to a hinge 38 provided on the rear side of the cover section 33. The distal end thereof forms a bifurcated section 37*x* that clamps a base section 41*a* of a cord 41 connected to the connector 40 and locks the connector 40.

When the cover section 33 is closed, the connector locking plate 37 is folded to the rear side of the cover section 33 by the hinge 38. When the cover section 33 is opened and the connector 40 is inserted, as shown in FIG. 12, the connector locking plate 37 is raised to clamp the base section 41*a* with the bifurcated section 37*x*. At this point, the connector locking plate 37 is locked by the hinge 38 to prevent the connector 40 from slipping off.

Fourth Embodiment.

Figure 13:
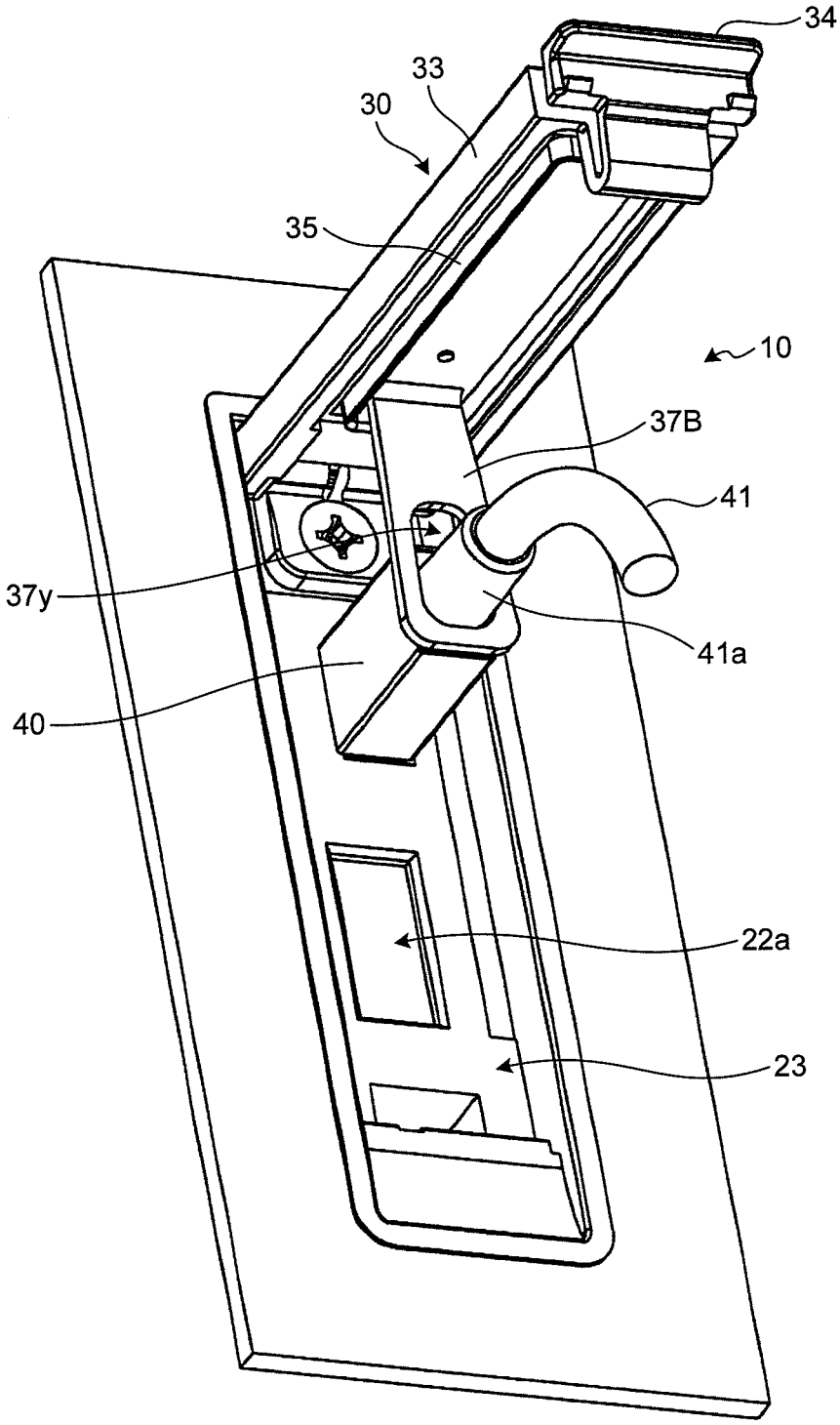
FIG. 13 is a perspective view of a connector locking plate in a fourth embodiment of the connector port according to the present invention.

FIG. 13 is a perspective view of a connector locking plate in a fourth embodiment of the connector port according to the present invention. As shown in FIG. 13, a connector locking plate 37B is integrally molded with the packing 35, which is fixedly attached to the rear surface of the cover section 33, by elastomer. A locking hole 37*y* through which the connector 40 is inserted to hold the base section 41*a* of the cord 41 and lock the connector 40 is formed in the connector locking plate 37B.

When the cover section 33 is closed, the connector locking plate 37B is easily bent and folded to the rear side of the cover section 33. When the cover section 33 is opened and the connector 40 is inserted, as shown in FIG. 13, the connector locking plate 37B rises with elasticity, stretches the locking hole 37*y* to have the connector 40 inserted therein, and holds the base section 41*a* of the cord 41 to lock the connector 40.

Fifth Embodiment.

Figure 14:
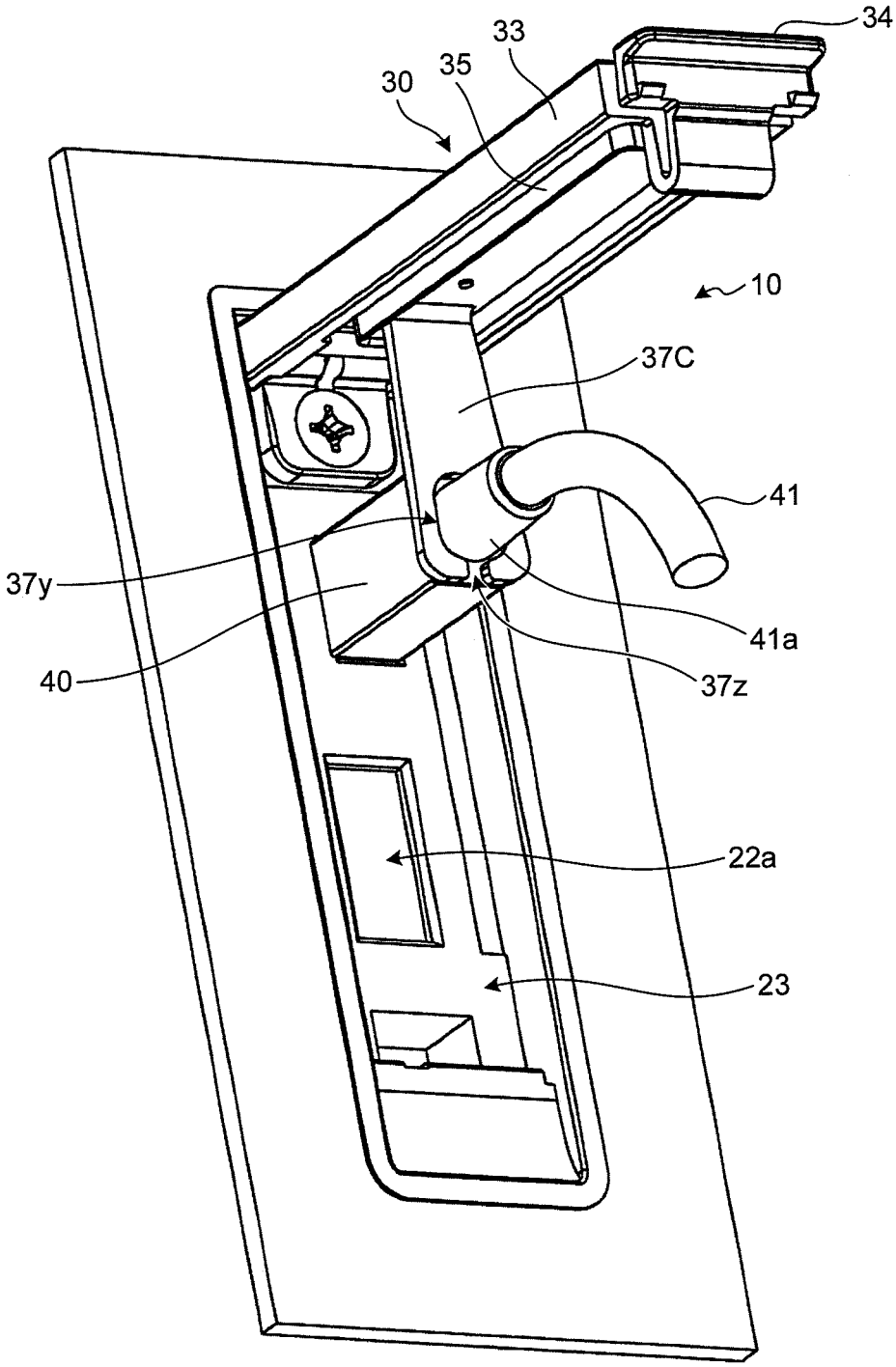
FIG. 14 is a perspective view of a connector locking plate in a fifth embodiment of the connector port according to the present invention.

FIG. 14 is a perspective view of a connector locking plate in a fifth embodiment of the connector port according to the present invention. As shown in FIG. 14, a connector locking plate 37C is integrally molded with the packing 35, which is fixedly attached to the rear surface of the cover section 33, by elastomer. The locking hole 37*y* that holds the base section 41*a* of the cord 41 is formed in the connector locking plate 37C. A cutout section 37*z* is provided on the outer periphery of the locking hole 37*y*. The cutout section 37*z* can be provided on a lower side of the locking hole 37*y* or can be provided on the right side or the left side of the locking hole 37*y*.

When the cover section 33 is closed, the connector locking plate 37C is easily bent and folded to the rear side of the cover section 33. When the cover section 33 is opened and the connector 40 is inserted, as shown in FIG. 14, the connector locking plate 37C rises with elasticity, opens the locking hole 37*y* from the cutout section 37*z*, and clamps to hold the base section 41*a* of the cord 41 to lock the connector 40.

Industrial Applicability

As explained above, the connector port according to the present invent ion is useful as a connector port provided in a display.

The invention claimed is:

1. A connector port provided on an outer surface of a housing of an electronic device, comprising:

a connector holding section that is formed in the housing and has a connector opening; and an opening/closing cover including an attaching section that is screwed to the connector holding section, a flat cover section that is pivotably supported by the attaching section at a proximal end thereof and opens and closes the connector opening, and an elastically deforming section that is provided at a distal end of the cover section and elastically deforms to engage in the connector holding section, and wherein the attaching section of the opening/closing cover includes an attaching plate in which a taper screw washer and a screw through-hole for a flat head screw are formed and a supporting section provided at an edge of the attaching plate and set in press contact with a side of the cover section, and a slit extending from a center of the supporting section to the screw through-hole is formed in the attaching section.

2. The connector port according to claim 1, wherein locking sections that engage in engaging sections formed in the connector holding section to position the attaching plate and regulate a widening amount of the attaching plate are respectively provided on both sides of the slit in the attaching plate.

3. A connector port provided on an outer surface of a housing of an electronic device, comprising:

a connector holding section that is formed in the housing and has a connector opening; and an opening/closing cover including an attaching section that is screwed to the connector holding section, a flat cover section that is pivotably supported by the attaching section at a proximal end thereof and opens and closes the connector opening, and an elastically deforming section that is provided at a distal end of the cover section and elastically deforms to engage in the connector holding section, and wherein a foldable connector locking plate that prevents a connector inserted into the connector opening from slipping off is provided on a rear side of the cover section, and wherein the connector locking plate is integrally molded with a packing, which is fixedly attached to the rear side of the cover section, by elastomer, and a locking hole through which the connector is inserted to hold the cord base section and lock the connector is formed in the connector locking plate.

4. The connector port according to claim 3, wherein a cutout section is provided in an outer periphery of the locking hole of the connector locking plate.

* * * * *